United States Patent [19]

Flanigan

[11] Patent Number: 4,614,397

[45] Date of Patent: Sep. 30, 1986

[54] TERMINAL PLATE ASSEMBLY

[75] Inventor: Paul J. Flanigan, Clay, N.Y.

[73] Assignee: Carrier Corporation, Syracuse, N.Y.

[21] Appl. No.: 809,620

[22] Filed: Dec. 16, 1985

[51] Int. Cl.[4] ..... H01B 17/30

[52] U.S. Cl. ..... 339/132 B; 339/94 M

[58] Field of Search ..... 339/132 B, 126 R, 99 A, 339/99 M; 179/151, 152 R, 152 G, 153 R

[56] References Cited

U.S. PATENT DOCUMENTS

| | | | |
|---|---|---|---|
| 1,813,716 | 7/1931 | Thordarson | 174/153 R |
| 1,932,456 | 10/1933 | Gaston | 175/361 |
| 2,438,572 | 3/1948 | McCormack | 339/94 A |
| 3,023,268 | 2/1962 | Preiser et al. | 174/153 R |
| 3,792,193 | 2/1974 | Price et al. | 174/153 R |
| 3,850,501 | 11/1974 | Butterfield et al. | 339/263 R |
| 4,025,714 | 5/1977 | Quick et al. | 174/18 |

FOREIGN PATENT DOCUMENTS

| | | | |
|---|---|---|---|
| 1013739 | 8/1957 | Fed. Rep. of Germany | 174/151 |

*Primary Examiner*—Eugene F. Desmond
*Attorney, Agent, or Firm*—David J. Zobkiw

[57] ABSTRACT

A terminal plate assembly has a one piece inner terminal block for three pins or bolts and a separate outer terminal block for each pin or bolt. Sealing between the terminal plate and each pin is accomplished by two O-ring seals which are squeezed between the inner and outer terminal blocks. Additionally, one of the O-rings also serves to hold the assembled terminal blocks in place with respect to the terminal plate.

6 Claims, 6 Drawing Figures

TERMINAL PLATE ASSEMBLY

BACKGROUND OF THE INVENTION

Where electrical terminals extend through a sealed casing such as that of a semi-hermetic compressor, the structure must seal against fluid leaks. Additionally, the structure must resist short circuits which can destroy the terminal. The short circuit can be established over any of three paths between the terminal plate and a terminal pin. The path can be established over the exterior of the terminal block for the portion within the housing or for the portion exterior of the housing. The third path is through the terminal plate assembly where the terminal blocks are mating parts and can provide a short circuit if moisture has leaked into the gaps between the mating parts.

SUMMARY OF THE INVENTION

The present invention is directed to a terminal plate assembly having a one piece inner terminal block for three terminal pins or bolts and a separate outer terminal block for each pin or bolt. To provide a greater resistance to short circuits, seals are located between the plate and the terminal blocks and between the pins or bolts and the terminal blocks.

It is an object of this invention to provide a terminal plate assembly which has a reduced number of parts and ease of correct assembly.

It is a further object of this invention to provide a terminal plate assembly suitable for use in replacing existing terminal plate assemblies.

It is another object of this invention to increase substantially the over-surface arc tracking length between the terminal pins or bolts and the terminal plate. These objects, and others as will become apparent hereinafter, are accomplished by the present invention.

Basically, an inner terminal block receives three terminal pins or bolts such that they are properly oriented for attachment to the motor leads. A separate outer terminal block is provided for each pin or bolt. Sealing between the terminal plate and each pin is accomplished by two O-ring seals. One O-ring seals between the plate and the terminal block and the second seals between the pin and the terminal block.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 2:
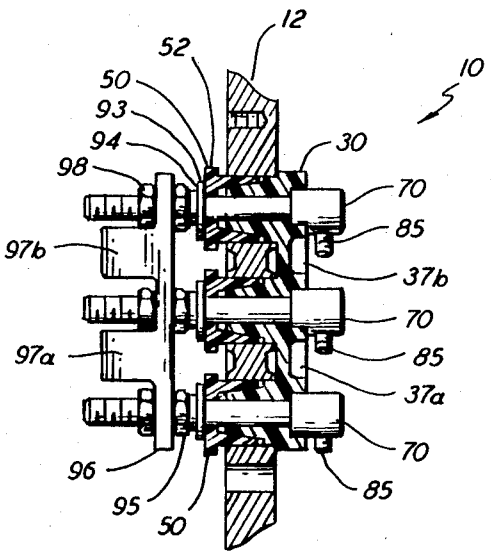
FIG. 2 is a sectional view taken along line 2—2 of FIG. 1.
Figure 1:
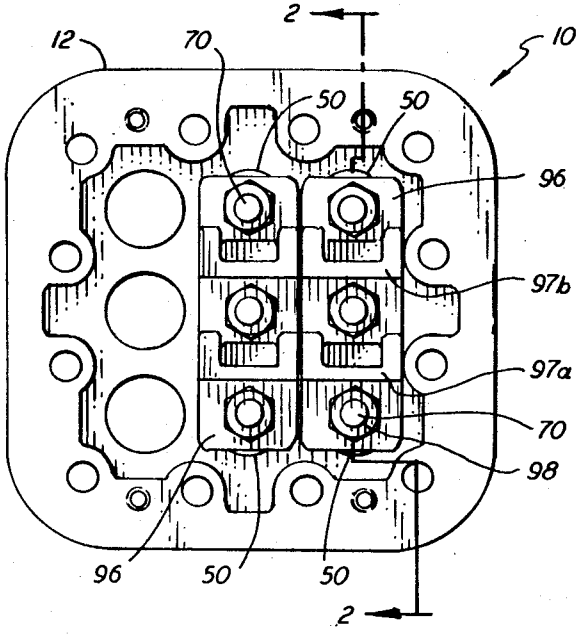
FIG. 1 is a view of the exterior portion of an assembled terminal plate assembly.
Figure 4:
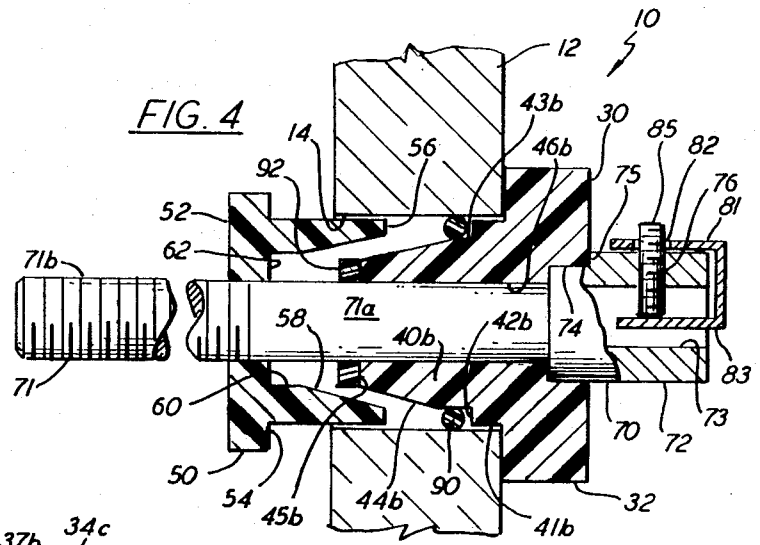
FIG. 4 is a sectional view of a partially assembled terminal plate assembly taken along line 4—4 of FIG. 3.
Figure 5:
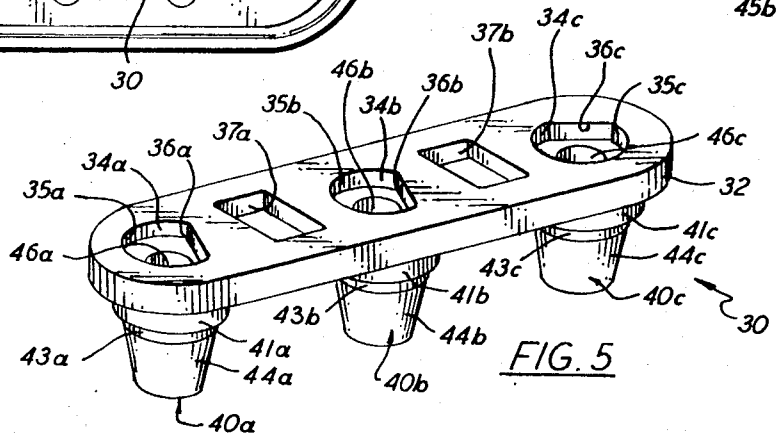
FIG. 5 is a pictorial view of an inner terminal block.

In the Figures, the numeral 10 generally designates a terminal plate assembly. The terminal plate 12 has two sets of three equally spaced holes or bores 14 for receiving two corresponding inner terminal blocks 30 and six corresponding outer terminal blocks 50 as is best shown in FIGS. 2 and 4. Referring specifically to FIG. 5, it will be noted that inner terminal block 30 is made up of a generally flat elongated portion 32 having on one side thereof three equally spaced non-circular holes or bores 24*a–c* each having a periphery defined by a portion of a circle 35*a–c* and a chord 36*a–c*. It will be noted that the orientation of chords 36*a* and *b* is the same but that chord 36*c* has a different orientation by about 90°. Depression or relieved area 37*a* separates bores 34*a* and *b* and depression or relieved area 37*b* separates bores 34*b* and *c*. On the opposite side of flat elongated portion 32 from depressions 37*a* and *b* are three uniformly spaced generally conical projections 40*a–c*. Referring specifically to FIG. 4, it will be noted that generally conical projection 40*b* which is exemplary of conical projections 40*a* and *c* is made up of a first cylindrical portion 41*b* which forms a flange with elongated portion 32, a second cylindrical portion 43*b* which forms a flange 42*b* with first cylindrical portion 41*b*, and truncated conical portion or frustum 44*b* having an annular end face 45*b* surrounding bore 46*b*. Bore 34*b* forms the counterbore portion of bore 46*b*.

Figure 6:
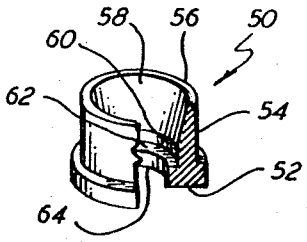
FIG. 6 is a sectional pictorial view of an outer terminal block.

As best shown in FIGS. 4 and 6, each of the outer terminal blocks 50 has a first flat annular portion 52, an outer cylindrical portion 54, a second flat annular portion 56, an inner conical portion 58, an inner cylindrical portion 60 and annular end wall 62. The first cylindrical portion 41*a–c* of conical projections 50*a–c* has essentially the same diameter as outer cylindrical portion 54 of outer terminal blocks 50 and, as is clearly shown in FIG. 4, this is less than the diameter of bores 14 in terminal plate 12. The slope of truncated conical portions 44*a–c* is complementary to the slope of inner conical portions 58 of outer terminal block 50 and are of essentially the same axial length. The bores 46*a–c* in block 30 are coaxial with the bores 64 in blocks 50, in the assembled device, and are of the same diameter.

Referring specifically to FIG. 4, pin or bolt 70 has a body portion 71 including an unthreaded portion 71*a* and a threaded portion 71*b* and a head portion 72. Head portion 72 is generally cylindrical with a bore 73 and a recessed portion which is defined by flat surface 74 and shoulder 75 so that the recessed portion of head portion 72 is matingly received in a corresponding hole or bore 34*a–c* in a predetermined orientation. A threaded radial bore 76 is formed through one wall of head portion 72. A generally U-shaped clamping member 80 has a first leg member 81 with hole 82 formed therein and a second leg member 83. Screw 85 extends through hole 82 in leg 81, is threadably received in bore 76 and engages leg 83.

Figure 3:
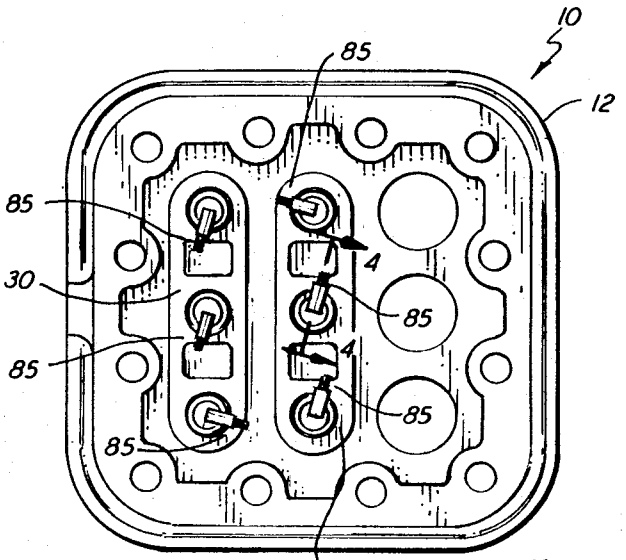
FIG. 3 is a view of the interior portion of an assembled terminal plate assembly.

In assembling terminal plate assembly 10, conical projections 40*a–c* are inserted as far as possible into corresponding holes or bores 14 in terminal plate 12. Before or after inserting conical projections 40*a–c* in bores 14, a preferably circular cross sectional O-ring 90 is placed over conical portions 40*a–c*. Also before or after inserting conical projections 40*a–c* into bores 14, body portion 71 of pins or bolts 70 are inserted into bores 46*a–c* and after pins or bolts 70 are inserted into bores 46*a–c*, a preferably rectangularly cross sectional O-ring 92 is placed over each pin or bolt 70 so as to be located at the unthreaded portion 71*a*. When pins or bolts 70 are inserted into bores 46*a–c*, the recess defined by flat surface 74 and shoulder 75 permits the mating insertion of head portions 72 into holes or bores 34 in a predetermined orientation as is best shown in FIG. 3. As a result of the predetermined orientation of head portions 72, the screws 85 are also in a predetermined orientation. The predetermined orientation of screws 85 serves to insure access to the screws 85 for securing and/or releasing the motor lead wires (not illustrated). The motor lead wires are held in place by placing each of the lead wires in one of the bores 73 and advancing the corresponding screw 85 so as to force leg 83 of U-shaped clamping member against the lead and to squeezingly secure the lead between leg 83 and the opposite wall of bore 73. The securing of the leads to pins or bolts 70 can be done before or after their insertion into bores 46*a–c* as dictated by assembling convenience.

With inner terminal block 30 inserted into holes or bores 14 of terminal plate 12 and with pins or bolts 70, and O-rings 90 and 92 in place as described, outer terminal blocks 50 are placed over pins 70 by putting body portion 71 of pins 70 into bore 64, placing washers 93 and lock washers 94 onto body portions 71 and threading nuts 95 onto threaded portions 71*b*. The inner terminal block 30 is already as far into holes or bores 14 as possible, and maintained that way, the advancing of nuts 95 forces outer terminal blocks 50 into engagement with inner terminal block 30. Engagement between blocks 30 and 50 is progressive in that each O-ring 90 is engaged by flat annular portion 56 and a corresponding flange of which only 42*b* is illustrated. Similarly, each O-ring 92 is engaged by annular end wall 62 and a corresponding end face of which only 45*b* is illustrated. The described engagement with O-rings 90 and 92 is axial and produces a sealing engagement between the O-rings 90 and 92 and the contacting surfaces. Continued advancement/tightening of nuts 95 causes the axial compression of O-rings 90 and 92 which are thereby effectively radially extruded. For O-rings 90, this radial extrusion forces them into sealing contact with the second cylindrical portions 43*a–c* and into sealing contact with the walls of holes or bores 14. The sealing contact of O-rings 90 with the walls of holes or bores 14 also serves as the only force for holding the terminal blocks 30 and 50 in place with respect to terminal plate 12 since they would otherwise be freely movable in bores 14 since flat annular portion 52 is clearly spaced from plate 12, as shown in FIG. 2, and would otherwise permit a reciprocating movement of the assembled terminal blocks 30 and 50 with respect to bores 14. The resistance to extrusion of O-rings 90 and 92 and the availability of an open area into which they can extrude will generally determine the relative position of conical portions 44*a–c* and 58 with their physical contact being a limiting position which is not ordinarily reached.

A block connector 96 would then be inserted onto threaded portions 71*b* of pins or bolts 70. Block connectors 96 have two U-shaped spacers or shields 97*a* and *b* for spacing the leads (not illustrated) connected to threaded portions 71*b*for supplying power to the compressor. Nuts 98 hold the block connectors 96 in place.

The inner and outer terminal blocks 30 and 50, respectively, are made of a non-arc tracking material such as Valox 752 which is a thermoplastic polyester resin available from General Electric. Referring now to FIG. 2, it will be noted that the interior, straight line, over surface connection between pins or bolts 70 includes depression or relieved area 37*a* or *b* which adds extra distance and thereby resistance to a potential short circuit. Similarly, on the outside the surface connection between pins or bolts 70 and the plate 122 is around and over the flat annular portion 52 together with a portion of outer cylindrical portions 54. The establishment of an electrical path from pin 70 to plate 12 through the terminal blocks 30 and 50 requires a failure of the seals of O-rings 90 and 92 so as to permit leakage of moisture into the space between conical portions 44*a–c* and 58 to establish an over surface electrical path. It will be noted that the path over conical portions 44*a–c* and 58 is much longer than the radial distance between pin 70 and plate 12 and thereby provides a greater resistance than a radial path.

Although a preferred embodiment of the present invention has been illustrated and described other modifications will occur to those skilled in the art. It is therefore intended that the present invention is to be limited only by the scope of the appended claims.

What is claimed is:

1. A terminal plate assembly comprising:

(I) an inner terminal block including:

(a) a generally flat elongated portion;

(b) three equally spaced projections extending from one side of said flat elongated portion and each serially including a first cylindrical portion having a first diameter, a second cylindrical portion having a second diameter which is less than and first diameter with said first and second cylindrical portions together defining a flange, a frustum of a cone, an axial bore extending through said frustum, said first and second cylindrical portions and said flat elongated portion;

(c) three equally spaced holes in the other side of said flat elongated portion with each of said holes being only a portion of a circle and serving as a counterbore for a corresponding one of said axial bores;

(II) a plurality of outer terminal blocks each including:

(a) an outer cylindrical portion having said first diameter and terminating in a flat annular portion;

(b) a recess defined by a conical portion extending from said flat annular portion and being of mating configuration to said frustum and an inner cylindrical portion terminating in an annular end wall which forms an extension of a corresponding one of said axial bores in an assembled terminal plate assembly;

(III) a plurality of pins each including:

(a) a body portion including an unthreaded portion and a threaded portion for securing to a power source;

(b) a head portion for securing to a motor lead;

(c) a portion of said head portion being shaped so as to be matingly received in a corresponding one of said three equally spaced holes whereby a pin extends through said axial bore and one of said outer terminal blocks can be placed thereon so that said pin extends through said extension of said bore;

(IV) first O-ring means adapted to be placed on each said second cylindrical portion and to be squeezingly engaged in a sealing engagement between said flange and said flat annular portion;

(V) second O-ring means adapted to be placed on each said unthreaded portion of said pin and to be squeezingly engaged between the end of said frustum and said annular end wall;

(VI) a plurality of nuts for threadably engaging said threaded portions of each of said pins to cause said inner and outer terminal blocks to come together and thereby squeezingly engage said first and second O-ring means in a sealing engagement and to cause said first O-ring to be radially extruded to thereby additionally secure said inner and outer terminal blocks in place with respect to a surrounding structure.

2. The terminal plate assembly of claim 1 further including a pair of depressions in the other side of said flat elongated portion intermediate respective pairs of said three equally spaced holes so as to provide an increased, over surface path between pins placed in adjacent ones of said three equally spaced holes.

3. The terminal plate assembly of claim 1 wherein said plurality of pins each include means for securing a motor lead thereto and said portion of said head portion which is shaped so as to be matingly received in a corresponding one of said three equally spaced holes is located so as to position said means for securing in a desired pattern.

4. A terminal plate assembly comprising:

(I) a plate having three equally spaced holes;

(II) an inner terminal block for insertion in said plate including:

(a) a generally flat elongated portion;

(b) three equally spaced projections extending from one side of said flat elongated portion and each serially including a first cylindrical portion having a first diameter which is less than the diameter of said equally spaced holes so as to be inserted therein with a clearance, a second cylindrical portion having a second diameter which is less than said first diameter with said first and second cylindrical portions together defining a flange, a frustum of a cone, an axial bore extending through said frustum, said first and second cylindrical portions and said flat elongated portion;

(c) three equally spaced holes in the other side of said flat elongated portion with each of said holes being only a portion of a circle and serving as a counterbore for a corresponding one of said axial bores;

(III) a plurality of outer terminal blocks each including:

(a) an outer cylindrical portion having said first diameter and terminating in a flat annular portion;

(b) a recess defined by a conical portion extending from said flat annular portion and being of mating configuration to said frustum and an inner cylindrical portion terminating in an annular end wall which forms an extension of a corresponding one of said axial bores in an assembled terminal plate assembly;

(IV) a plurality of pins each including:

(a) a body portion including an unthreaded portion and a threaded portion for securing to a power source;

(b) a head portion for securing to a motor lead;

(c) a portion of said head portion being shaped so as to be matingly received in a corresponding one of said three equally spaced holes of said inner terminal block whereby a pin extends through said axial bore and one of said outer terminal blocks can be placed thereon so that said pin extends through said extension of said bore;

(V) first O-ring means adapted to be placed on each said second cylindrical portion and to be squeezingly engaged in a sealing engagement between said flange and said flat annular portion and to matingly and fixedly engage the wall of one of said three equally spaced holes in said plate;

(VI) second O-ring means adapted to be placed on each said unthreaded portion of said pin and to be squeezingly engaged between the end of said frustum and said annular end wall;

(VII) a plurality of nuts for threadably engaging said threaded portions of each of said pins to cause said inner and outer terminal blocks to come together and thereby squeezingly engage said first and second O-ring means in a sealing engagement and to cause said first O-ring to be radially extruded to thereby additionally secure said inner and outer terminal blocks in place with respect to a surrounding structure.

5. The terminal plate assembly of claim 4 further including a pair of depressions in the other side of said flat elongated portion intermediate respective pairs of said three equally spaced holes in said inner terminal block so as to provide an increased, over surface path between pins placed in adjacent one of said three equally spaced holes.

6. The terminal plate assembly of claim 4 wherein said plurality of pins each include means for securing a motor lead thereto and said portion of said head portion which is shaped so as to be matingly received in a corresponding one of said three equally spaced holes in said inner terminal block is located so as to position said means for securing in a desired pattern.

* * * * *